US008205554B2

(12) United States Patent
Fink

(10) Patent No.: US 8,205,554 B2
(45) Date of Patent: Jun. 26, 2012

(54) FIRING APPARATUS FOR A PYROTECHNIC PROTECTION APPARATUS

(75) Inventor: Thomas Fink, Landshut (DE)

(73) Assignee: Schott AG (DE)

( * ) Notice: Subject to any disclaimer, the term of this patent is extended or adjusted under 35 U.S.C. 154(b) by 0 days.

(21) Appl. No.: 12/516,799

(22) PCT Filed: Nov. 27, 2007

(86) PCT No.: PCT/EP2007/010280

§ 371 (c)(1),
(2), (4) Date: Nov. 23, 2009

(87) PCT Pub. No.: WO2008/064858

PCT Pub. Date: Jun. 5, 2008

(65) Prior Publication Data

US 2010/0064923 A1 Mar. 18, 2010

(30) Foreign Application Priority Data

Nov. 28, 2006 (DE) ..... 10 2006 056 077

(51) Int. Cl.
*F42C 19/02* (2006.01)
*F42C 19/06* (2006.01)

(52) U.S. Cl. ..... 102/202.14; 102/202.9

(58) Field of Classification Search ..... 102/202.14, 102/202.9, 202.7, 202.5, 202.12
See application file for complete search history.

(56) References Cited

U.S. PATENT DOCUMENTS

| | | | | |
|---|---|---|---|---|
| 3,134,329 | A | 5/1964 | Zeman | |
| 3,274,937 | A | 9/1966 | Kyle | |
| 3,971,320 | A | 7/1976 | Lee | |
| 5,243,492 | A * | 9/1993 | Marquit et al. | 361/247 |
| 5,345,872 | A | 9/1994 | Takahashi et al. | |
| 5,621,183 | A | 4/1997 | Bailey | |
| 5,648,634 | A * | 7/1997 | Avory et al. | 102/202.1 |
| 5,728,964 | A * | 3/1998 | Avory et al. | 86/1.1 |
| 5,732,634 | A | 3/1998 | Flickinger et al. | |
| 5,763,814 | A * | 6/1998 | Avory et al. | 102/202.7 |
| 6,274,252 | B1 | 8/2001 | Naugler et al. | |

(Continued)

FOREIGN PATENT DOCUMENTS

DE 2904174 A1 8/1980

(Continued)

*Primary Examiner* — James Bergin
(74) *Attorney, Agent, or Firm* — Pitts & Lake, P.C.

(57) ABSTRACT

The invention relates to an apparatus, in particular a firing apparatus (1) for a pyrotechnic protection apparatus, in particular an airbag or belt pretensioner, comprising: a power leadthrough, in particular a metal fixing material leadthrough (2), comprising a base body (8) which is provided with a passage opening (7), and at least one metal pin (6) which is arranged in the passage opening (7) in the base body (8) in a fixing material (6); a housing part (19, 4) which at least partially accommodates the power leadthrough so as to form a space for accommodating a propellant charge (5); a casing (22) which at least partially surrounds the power leadthrough (2), the metal pin (6) and the housing part (19, 4); wherein the base body (8) has a thickness D in the range of from 2.0 mm to 0.1 mm, preferably in the range of from less than 1.0 mm to 0.1 mm, in particular less than 0.8 mm to 0.5 mm, and means (27) are provided on the metal pin (6) in such a way that the casing (22) engages with the metal pin, wherein the casing and the base body together absorb a pull-out force of the metal pin which is greater than 150 N, in particular greater than 165 N, preferably greater than 200 N, in particular greater than 250 N, in particular greater than 300 N.

20 Claims, 11 Drawing Sheets

U.S. PATENT DOCUMENTS

Figure 1A:
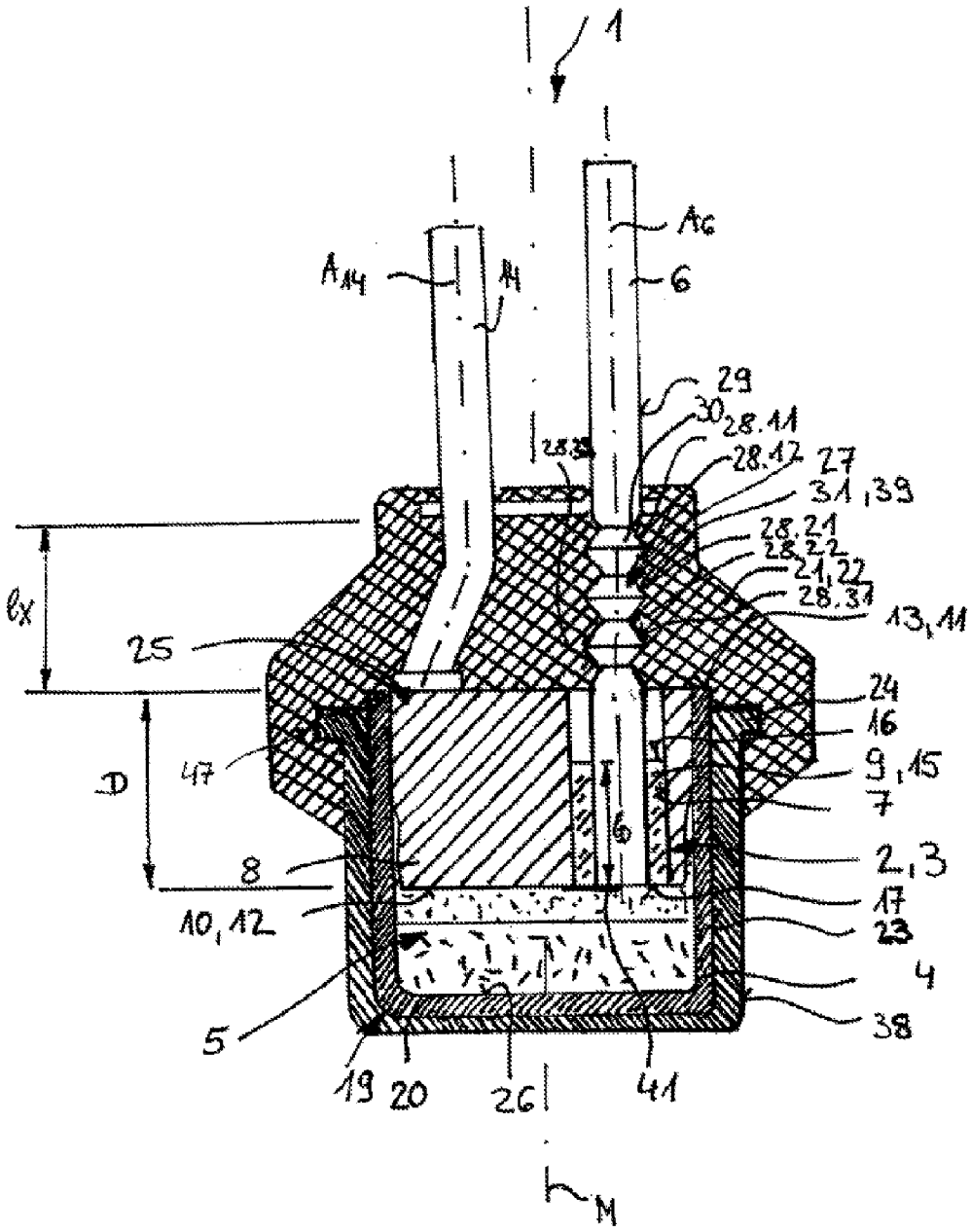

| | | | | |
|---|---|---|---|---|
| 7,770,520 | B2 * | 8/2010 | Fink et al. | 102/202.12 |
| 2002/0069781 | A1 | 6/2002 | Avetisian et al. | |
| 2006/0208474 | A1 * | 9/2006 | Kubo et al. | 280/806 |
| 2007/0207669 | A1 * | 9/2007 | Hummel et al. | 439/606 |

FOREIGN PATENT DOCUMENTS

| | | | |
|---|---|---|---|
| DE | 3415625 | A1 | 10/1985 |
| DE | 19927233 | A1 | 1/2001 |
| DE | 10133223 | A1 | 10/2002 |
| DE | 20314580 | U1 | 9/2004 |
| EP | 0248977 | A1 | 12/1987 |
| EP | 1225415 | A1 | 7/2002 |
| EP | 1286125 | A1 | 2/2003 |
| EP | 1455160 | A1 | 9/2004 |
| EP | 1491848 | A1 | 12/2004 |
| EP | 1813906 | A1 | 8/2007 |

* cited by examiner

FIRING APPARATUS FOR A PYROTECHNIC PROTECTION APPARATUS

The invention relates to a hermetically sealed firing apparatus for a pyrotechnic protection apparatus, particularly having the characteristics of the generic part of claim 1; further a pyrotechnic protection apparatus, particularly an airbag and belt pretensioner, comprising such a firing apparatus, and a method for the production of a metal fixing material leadthrough for a pyrotechnic protection apparatus.

Firing apparatuses for pyrotechnic protection apparatuses are known from prior art in a plurality of embodiments. The same are primarily utilized in belt pretensioners or airbags in motor vehicles. The same comprise a metal fixing material leadthrough for the leadthrough of current, and a cap, which is embodied in an open manner on one side and at least partially accommodates the metal fixing material leadthrough in the opening region while forming an intermediate or hollow space. For this purpose a metal fixing material leadthrough means a vacuum-sealed fusing of fixing materials, particularly glasses or plastics in metals. The metals act as electric conductors. Reference is also made to U.S. Pat. No. 5,345,872, U.S. Pat. No. 3,274,937. Such leadthroughs are also widely known in the electronics and electrotechnical industries. The material used for fusing, particularly glass, serves as an isolator in this case. Either one or two, or more than two metal pins may be guided through the leadthroughs. In a preferred embodiment having a metal pin the housing is placed on mass, in a preferred bipolar embodiment only one of the pins. A propellant charge is provided in the intermediate space between the metal fixing material leadthrough and the base of the cap. In order to avoid that the same may be modified under environmental influences, particularly moisture, the firing apparatus is hermetically sealed. The sealing is carried out via the cap, the metal fixing material leadthrough itself, and a casing which at least indirectly fixes the position of the cap as opposed to the metal fixing material leadthrough, which is embodied as a cast plastic component. For this purpose the casing may be directly cast with the cap, or the cap is encased by a cover, which is positively bonded to the casing.

Known firing apparatuses of the known or of a similar type are described in U.S. Pat. Nos. 6,274,252, 5,621,183, DE 29 04 174 A1, DE 199 27 233 A1, U.S. Pat. Nos. 5,732,634, 3,134,329, DE 34 15 625 A1, EP 1 225 415 A1, U.S. Pat. No. 3,971,320, EP 0 248 977 B1, US 2002/0069781 A1, DE 101 33 223 A1, EP 1 491 848 A1, and EP 1 455 160 A1, the disclosure content of which is included in the present application in its entirety. The previously mentioned firing units have two metal pins. However, electronic firing apparatuses having only one single pin are also possible.

A firing apparatus is known from EP 1 286 125, wherein a casing is provided, which also encases the metal pin, wherein the metal pin comprises means that form a toothed engagement with the casing. However, the firing apparatus according to EP 1 286 125 is not a hermetically sealed firing apparatus. In the firing apparatus according to EP 1 286 125 the base body having the metal pin that is fixed in the base body, for example, by means of glazing, is not directly welded to the metal firing cap, but instead the plastic material of the casing is inserted between the metal firing cap and the base body. In order to avoid penetration of moisture into the firing head in the leadthrough according to EP 1 286 125 that is not hermetically sealed, the base body itself is embodied as a common pivoting part having thicknesses of greater than 3.0 mm, and projections are provided on the metal pin, which are to delay the creepage distance of the moisture leading into the firing head. A power intake of the pull-out force by means of the plastic part is not provided according to EP 1 286 125. A further disadvantage of the embodiment according to EP 1 286 125 is that upon an explosion of the material in the firing head the force of the explosion directly acts upon the plastic part, and not upon the base body.

EP 1 491 848 also illustrates a firing apparatus having a casing made of a resin. The firing apparatus in EP 1 491 848 is a hermetic firing apparatus, since the base body is directly connected to the metal firing cap, such as by means of welding. In EP 1 491 848 the casing substantially only serves to insulate the metal pins from the housing. In EP 1 491 848 pivoting parts having thicknesses of greater than 3 mm are also utilized as base bodies. A power intake by the casing is not described in EP 1 491 848.

A generic metal fixing material leadthrough is known from the printed publication EP 1 455 160 A1. The same discloses a metal fixing material leadthrough, which is denoted as a glass metal leadthrough in a special embodiment, having a metal base body, through which at least one metal pin is guided. As far as two metal pins are provided in a preferred embodiment, one of the two creates the mass connection to the base body, at least indirectly, e.g. directly or indirectly via further elements. In the embodiment having two metal pins said metal pins are preferably arranged parallel to each other. For this purpose at least one of the metal pins is arranged in a passage opening in the base body, and fixed as opposed to the same by means of fixing material, preferably in the form of a glass stopper. In order to enable an assembly that is as simple as possible, the base body is formed by a sheet metal element, preferably a stamping part. Means for preventing a relative movement of the fixing material in the direction of the rear side as opposed to the interior circumference of the passage opening are provided between the front side and the rear side of the base body, particularly during firing. The means are an integral part of the base body, or form an assembly unit together with the same. The production of the base body by means of stamping provides the advantage of short production times, and allows a free configuration, particularly of the passage opening. However, depending on the material used the production by stamping is limited with regard to the thickness of the base body, and the pull-out force necessary for use in a pyrotechnic protection apparatus is not provided in case of a shortfall of the thickness. A metal fixing material leadthrough for firing apparatuses, particularly airbags or belt pretensioners, is known from EP-A-181 39 06, which is embodied as a stamping part. In order to provide the necessary pull-out forces, the stamping parts according to EP 18 139 06 could not be embodied thinner than 1.0 mm. Preferably, the range of the thicknesses of the stamping part was between 2.0 mm and 2.6 mm.

In case a pivoting part was used, the thicknesses were in a range of 3.2 mm to 5.0 mm.

The invention is therefore based on the task of further improving a firing apparatus of the type mentioned above such that a metal fixing material leadthrough can be provided even at a small installation size, particularly having small thicknesses, which provides a high degree of pull-out force for the metal pin as opposed to the metal fixing material leadthrough. Particularly, the component is to be characterized by a low material expense while simultaneously comprising a high degree of pull-out and pressing forces.

The solution according to the invention is characterized by the features of claim 1. Advantageous embodiments are reflected in the sub-claims.

An apparatus according to the invention, particularly a firing apparatus for a pyrotechnic protection apparatus, particularly an airbag or belt pretensioner, comprises a power leadthrough, preferably in the form of a metal fixing material leadthrough, comprising a base body equipped with a passage opening and at least one metal pin that is arranged or cast in the passage opening in the base body in a fixing material. A housing part is provided for encasing and sealing the propellant charge, which at least partially accommodates the metal fixing material leadthrough while forming an intermediate space. The same may also be denoted by a cap. A casing is provided for sealing, particularly for the hermetic sealing and fixing of the position of the individual elements to each other, which surrounds the metal pin on a partial section of the length thereof projecting from the metal fixing material leadthrough, and further indirectly positively bonds the leadthrough to the housing part, e.g. via the positive bonding between the housing part and the casing, and the positive bonding between the casing and the metal fixing material leadthrough.

Furthermore, means are provided between the casing and the metal pin such that the casing engages into the metal pin. Due to the fact that a casing is provided which at least partially surrounds both the metal pin and the housing it is possible to provide a firing apparatus comprising a base body that can be embodied as a stamping part in a very thin manner having thicknesses of preferably in a range of 2.0 mm to 0.1 mm, particularly in a range of less than 1.0 mm to preferably 0.5 mm. In particular, base bodies having thicknesses in a range of 0.8 mm to 0.5 mm, preferably, for example, of 0.6 mm, are conceivable. The passage opening incorporated in the base body has a diameter in a range of 5 mm to 1 mm, for example, a diameter of 1.5 mm in case of a metal pin having a thickness of 1 mm. Metal pins for firing apparatuses usually have a diameter of 2 mm to 0.45 mm. Surprisingly, hermetically sealed glass metal leadthroughs may also be obtained, if such thin base body metal pins are fixed using a fixing material, such as glass, protecting the propellant of the firing apparatus from moisture. Furthermore, the base body is connected to the cap, which is preferably embodied as a metal cap, in a hermetically sealed manner. Preferably the hermetically sealed connection is obtained by means of laser or electron beam welding. Hermetically sealed as used in the present application means a component, particularly a firing apparatus, which has a helium leakage rate of less than $1\cdot10^{-5}$ mbars·l/sec, preferably in a range of $1\cdot10^{-10}$ mbars·l/sec to $1\cdot10^{-6}$ mbar·l/sec. Preferably, a helium leakage rate according to DIN EN60068-2-17 or MIL-STD-883-method 1014.9 condition A4 is measured. The measuring devices Model MS 34T by VEECO, or Model UL 400 by LEYBOLD may be utilized as measuring devices for this purpose. The hermetically sealed connection prevents moisture from entering into the firing chamber between the base body and the cap.

Due to the surrounding or molding of at least part of the base body and of the metal pin utilizing a casing, it can be ensured that base bodies having a reduced stability at a thickness of less than 2 mm, particularly of less than 1 mm, withstand the high forces occurring during firing. This is achieved in that the base body, particularly the thin stamping part, is protected from bending during firing by means of the casing.

Pull-out forces greater than 150N, particularly greater than 165 N, especially preferably greater than 200 N, more preferably greater than 250 N, particularly preferred greater than 300 N may be realized by means of the solution according to the invention.

Pull-out force as used in the present application means the force that has to be exerted in order to pull out the metal pin from the fixing material in the passage opening. The high mechanical stability is obtained in the present firing apparatus in that both the metal pin and partially also the base body and partially the metal fixing material leadthrough are surrounded by the casing. The casing, or molding, respectively, protects the thin base body, particularly the stamping part, from bending. The means present in the metal pin, which may be grooves, for example, form a toothed engagement with the casing, and bring about a mechanical connection to the glass metal passage opening.

Preferred materials for the casing are plastics or fiberglass reinforced plastics, such as nylon. Glass powder in a polymer matrix, or glass powder reinforced plastics that may be cured via temperature or UV light, are also possible.

One example for a polymer matrix that may be embedded in glass is polymethyl methacrylate (PMMA).

As described above, the means on the metal pin increase the pull-out force for the metal pin guided in the metal fixing material leadthrough, such as by means of the creation of undercuts in the casing to be cast, which act as barbs. Furthermore, the same also indirectly bring about an increase of the pressing force necessary for the leadthrough from the base body of the metal fixing material leadthrough. For this purpose the installation space already required for the casing is also utilized such that no enlargement of the firing apparatus itself occurs based on the recommended measures. Firing apparatuses according to the invention may be utilized in a broader spectrum of applications due to the achievable increase of the pull-out forces and thus the stability, wherein the means for increasing the pull-out force contribute to preventing a relative movement between the metal pin and the casing, depending on the embodiment thereof. The solution according to the invention thus enables an increased stability while simultaneously reducing the thickness of the metal fixing material leadthrough, thus enabling other embodiment possibilities and types of manufacture, all leading to a more favorable production of the entire firing apparatus.

Using the solution according to the invention it is further possible to utilize especially metal pins, or pins, respectively, which may be produced and processed in a simpler and more cost-effective manner.

The means for preventing a relative movement between the metal pin and the casing preferably extends at least parallel to the longitudinal axis of the metal pin, as viewed in a partial region of the extension of the metal pin through the casing, preferably across the entire extension of the metal pin through the casing.

A plurality of possibilities exists with regard to the embodiment of the means. A plurality of the same have in common the creation of local cross-sectional modifications on the metal pin, while forming surface regions that are aligned at an angle to the longitudinal axis. The same may comprise the following:

a) grooves extending on the outer circumference of the metal pin, having different cross-sectional geometries, wherein the grooves extend at an angle to the longitudinal axis, preferably in a perpendicular manner,
b) external threads arranged on the outer circumference of the metal pin,
c) material constrictions and pinchings provided on the outer circumference of the metal pin,
d) at least one projection arranged on the outer circumference of the metal pin and aligned in radial direction, preferably a plurality of projections,
e) a partial region arranged on the outer circumference of the metal pin, having a high surface roughness in the range of $\mu \geqq 2$ μm.

Preferably, embodiments are selected, which are easy to produce and form defined resistance surfaces, such as the incorporation of circumferential grooves or ridges, or a thread, and which do not enlarge the installation size as opposed to conventional embodiments. The individual possibilities may also be used in combination.

As mentioned above, the casing is preferably embodied from plastic. Thermoplastics, particularly polyamides, particularly linear aliphatic polyamides, such as nylon, are conceivable. Preferably, materials are used, which are easy to cast into the desired final shape.

According to a further improvement the measures for increasing the pull-out force and/or pressing force can be combined with measures for increasing the force between the metal pin and the fixing material. Depending on the embodiment, the stability of the entire firing apparatus can therefore be increased by a multitude.

The power leadthrough, particularly the metal fixing material leadthrough, comprises a base body, through which at least one metal pin is guided. If two metal pins are provided in a preferred embodiment, one of the two carries out the mass connection to the base body at least indirectly, e.g. directly or indirectly via further elements. In an embodiment having two metal pins said metal pins are preferably arranged parallel to each other. For this purpose at least one of the metal pins is arranged in a passage opening in the base body, and fixed as opposed to the same by means of a fixing material, preferably in the form of a glass stopper. In order to improve the problem arising during the melting of the individual metal pin in a passage opening, and to further improve safety against a falling out of the unit, fixing material, and metal pin, the invention provides the means for preventing a relative movement of the fixing material in the direction of the rear side of the base body, e.g. of the side facing away from the propellant charge as opposed to the interior circumference of the passage opening. The same quasi function as barbs, and lead to a positive fit between the fixing material stopper, particularly the glass stopper, and the base body upon a relative movement in the direction of the rear side. The same comprise, for example, at least one local bottleneck in the passage opening, wherein the same may be provided in the entire region of the interior circumference, except on the front of the base body.

The decisive factor is that the local bottleneck of the cross-section occurs within the region of the rear side, or even between the rear and the front side, wherein, however, the front side is always characterized by a greater diameter. For this purpose the ratios stated below always refer to the greatest cross-section, or the greatest dimension of the passage opening. The reduction of the dimension of the region adjoining the same perpendicular to the direction of alignment of the passage opening, based from the axis, which results by means of the undercut, or the difference between the dimensions of the largest cross-section and the smallest in the embodiments of the base body as a stamping part is preferably in a range between 0.05 mm to 1 mm, preferably 0.08 mm to 0.9 mm, preferably between 0.1 mm to 0.3 mm. Due to this variable a respective surface enlargement is created on the interior circumference of the passage opening, which suffices in order to maintain the ratio between thickness and dimension of the passage opening in the sense of a very low thickness, and to simultaneously increase the pull-out force accordingly. In case the passage opening is embodied, for example, in a circular manner, the largest dimension of a cross-section is characterized by the diameter of the passage opening; in the case of an elliptical shape the largest dimension is the dimension of the large axis of the ellipse.

A multitude of possibilities exists for the specific embodiment of the means for preventing a relative movement between the fixing material and the passage opening, particularly for preventing slippage. The same are characterized by measures on the base body and/or on the metal pin. In the simplest of cases measures are used on the base body, which can be realized at the same time as the stamping operation takes place during manufacture. For this purpose the passage opening is characterized by a change in the course of the cross-section between the rear and the front. In the simplest case at least two regions of different interior dimensions are provided, while different diameters are provided in embodiments as passage openings having a circular cross-section. The cross-sectional change may occur in steps, but continuously. In the latter case the passage opening between the front and the rear is embodied in a conical manner, wherein the same tapers toward the rear side.

The pull-out force can be significantly increased by means of the measures described in the region of the passage opening.

The measures on the base body are usually further characterized by providing multiple recesses, or projections, respectively. The same form at least one undercut arranged at the interior circumference of the passage opening in the base body between the rear side and the front side, when viewed from the rear side, wherein the front side is free of such undercuts. In a symmetric embodiment of the passage opening the same is characterized by three partial regions—a first partial region extending from the rear side in the direction of the front side, a second partial region adjoining the same and a third partial region extending from the front side in the direction of the rear side. The second partial region is characterized by smaller dimensions of the passage opening than the first and the third partial regions. Preferably, the first and the third partial regions are characterized by identical cross-sectional dimensions.

Methods are selected in embodiments having more than two regions of different dimensions, particularly different diameters, which are created by means of processing the base body on both sides. If an asymmetrical design of the passage opening is selected in the previously described embodiments, a form of the passage opening is preferably chosen in said embodiments having more than two regions, which can be used in any manner with regard to the installation position. Based on a theoretical center axis extending perpendicular to the pin axis of the pin guided in the base body and extending symmetrically, the same is embodied in a symmetrical manner. In this manner the front and rear sides may also be exchanged with regard to the function of the same. The undercuts formed by the same counteract any possible movements of the fixing material stoppers in both directions.

Another possibility for preventing relative movements between the fixing material stopper and the passage opening exists in the embodiment of a force-fitting connection between the same.

According to an advantageous further improvement measures are provided on the metal pin for the additional prevention of relative movements under load between the metal pin and the fixing material. The same may be projections or recesses extending across the entire outer circumference of the metal pin, or any desired or firmly pre-defined and firmly arranged projections positioned adjacent to each other in circumferential direction. Due to the measures on the metal pin the pull-out force of the metal pin is greater than 150 N and is particularly in a range of 150 N to 380 N, particularly 160 N to 380 N, preferably 300 to 380 N. As previously described, the high pull-out forces in relatively think base bodies are enabled by means located on the metal pin in the region of the casing. The means preferably also prevent a relative movement between the metal pin and the casing.

If the base body is made of metal the passage opening thereof is produced by means of stamping. In a further improved embodiment the entire base body, e.g. the outer circumference of the base body and the passage opening may be produced by means of stamping. In this case the base body is embodied as a stamping part. The thickness of the stamping part means the extension or dimension in the direction of height, or in the direction of the extension of the passage opening. The geometric axis of the passage opening is determined depending on the embodiment of the same. In case of a symmetrical embodiment the same corresponds to the symmetric axis, otherwise the same corresponds to the theoretic center axis.

Base bodies having thicknesses between 0.1 mm and 5 mm, preferably 0.1 mm to 2 mm, particularly preferred 0.1 mm to 1.0 mm are utilized for use in firing apparatuses for airbags according to the present invention. This results in a significant material savings due to the low dimensions as opposed to pivoting parts having thicknesses of, for example, 3.2 mm to 5 mm, even in the case of consistently large metal pins, and an energy saving production. The decrease of the support surface for the fixing material stopper inherent in the thickness reduction may be compensated as described by means of simple measures requiring hardly any additional expense with regard to the function thereof.

No limitations exist with regard to the cross-sectional geometry of the passage opening. Preferably, however, a circular or oval cross-section is selected for obtaining a uniform clamping distribution in the connection between the fixing material and the passage opening. The diameter of the metal pin is, for example, 0.8 to 1.2 mm. The diameters of the passage opening are then in the range of 1.0 mm to 5.0 mm.

The combination of the solution according to the invention utilizing a base body in the form of a stamping part enables the use of more cost-effective production methods and base materials, wherein the material use is significantly reduced to a minimum. Furthermore, the entire base body may be embodied as an integral component, into which the metal pin is fused by means of fixing material, e.g. the glass stopper. A further substantial advantage is that the pushing out of the glass stopper from the passage opening together with the metal pin under increased loads onto the glass stopper, such as a pressure load, is safely prevented. The entire embodiment has a lower installation height as opposed to the pivoting part and ensures a safe fixing of the glass stopper in the base body, even at a higher pressing force.

According to a particularly advantageous embodiment the second metal pin is fixed or attached on mass as the mass pin on the rear of the base body. In this manner additional measures to fix a metal pin fixed in the base body using fixing material on mass, or to electrically couple the same to the base body, can be omitted. Furthermore, only one pin must be fixed in a passage opening, wherein the possibilities of safely fixing the single pin completely in the circumferential direction become more manifold, and the possible connecting surface for the mass pin can be enlarged.

A glass stopper, a ceramic stopper, a glass ceramic stopper, a plastic, a high-performance polymer, or a glass/polymer mixture, for example, may be used as the fixing material.

The solution according to the invention can be utilized both for applications having embodiments involving only one metal pin, and having two metal pins. The said possibilities for preventing a relative movement between the single pin and the casing may be combined with the possibilities for preventing a relative movement between the housing part, or cap, and the casing and/or base body and casing. Said possibilities usually comprise a form fit by means of a bond, which is realized via projections reaching into the casing, and indirectly serve for further increasing the pull-out force.

The firing apparatuses may be used in gas generators, such as hot gas generators, cold gas generators, hybrid generators. Particularly preferred fields of application are firing apparatuses for pyrotechnic protection systems, such as airbags and belt pretensioners.

In addition to the apparatus the invention also discloses a method for the production of a metal fixing material leadthrough for a pyrotechnic protection apparatus, particularly an airbag or a belt pretensioner, comprising the following steps.

Initially a base body having a thickness D in the range of 2.0 mm to 0.1 mm, preferably in the range of less than 1.0 mm to 0.1 mm, particularly having a thickness of between 0.8 mm to 0.5 mm, comprising a passage opening, is created, for example, by means of stamping. In a further step a metal pin is fixed in the passage opening in a fixing material. Subsequently the base body and the metal pin are equipped with a bridge wire, and the cap, e.g. the pyrotechnical cap, is attached and hermetically sealed to the base body, particularly welded to the same. Hermetically sealed in the sense of the present application means a component having a helium leakage rate of less than $1\cdot10^{-5}$ mbars·l/sec, preferably within a range of $1\cdot10^{-10}$ mbars·l/sec to $1\cdot10^{-6}$ mbars·l/sec. Preferably the helium leakage rate is measured according to DIN EN60068-2-17 or the MIL-STD-883-method 1014.9 condition A4. The measuring devices Model MS 34T by VEECO, or Model UL 400 by LEYBOLD may be utilized as measuring devices for this purpose. Finally, the component is at least partially equipped with a casing such that the pull-out force of the metal pin is greater than 150 N, particularly greater than 165 N, preferably greater than 200 N, particularly greater than 250 N, especially preferred greater than 300 N. This may be carried out, for example, by means of injecting both the metal pin and the base body using plastic.

Figure 1B:
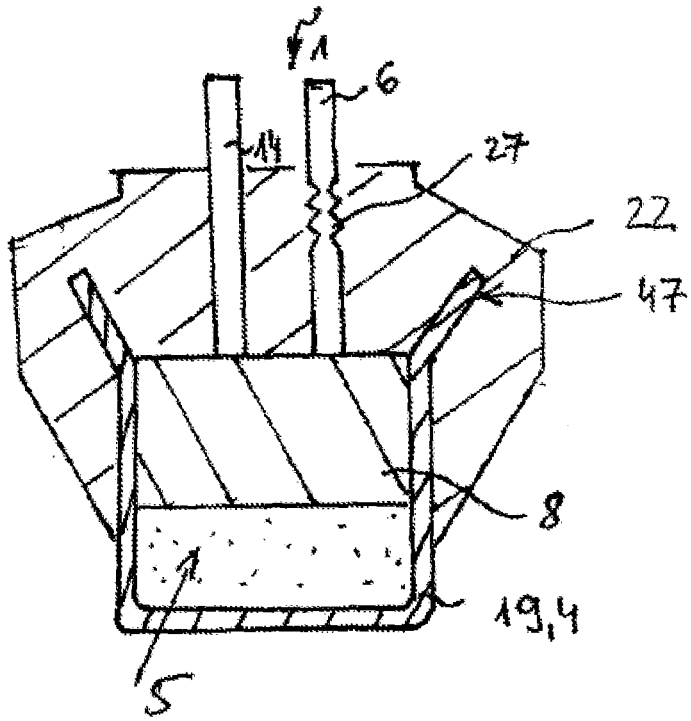
Figure 1C:
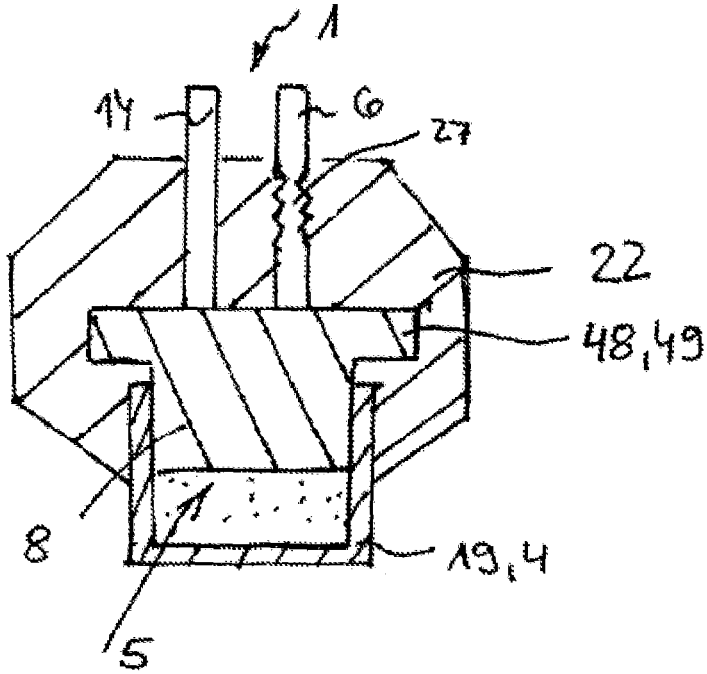
Figure 2B:
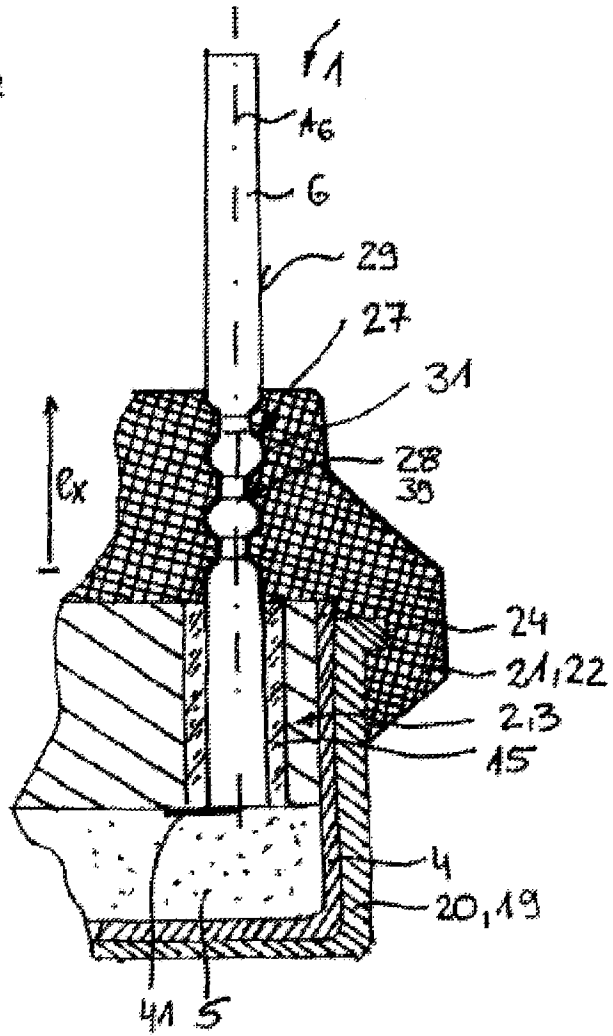
Figure 2A:
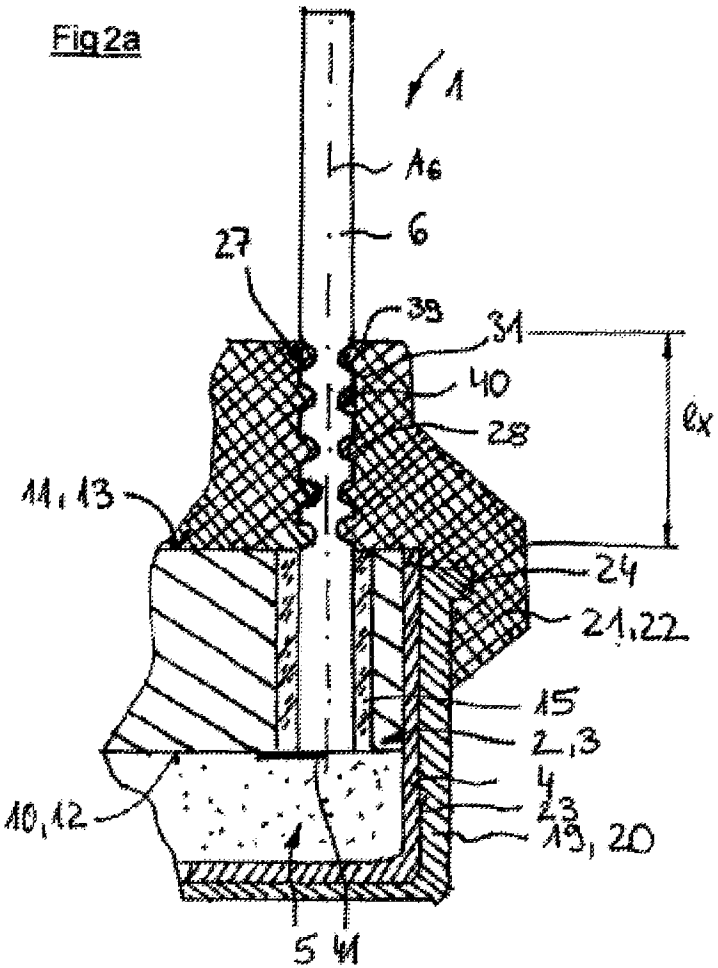
Figure 4:
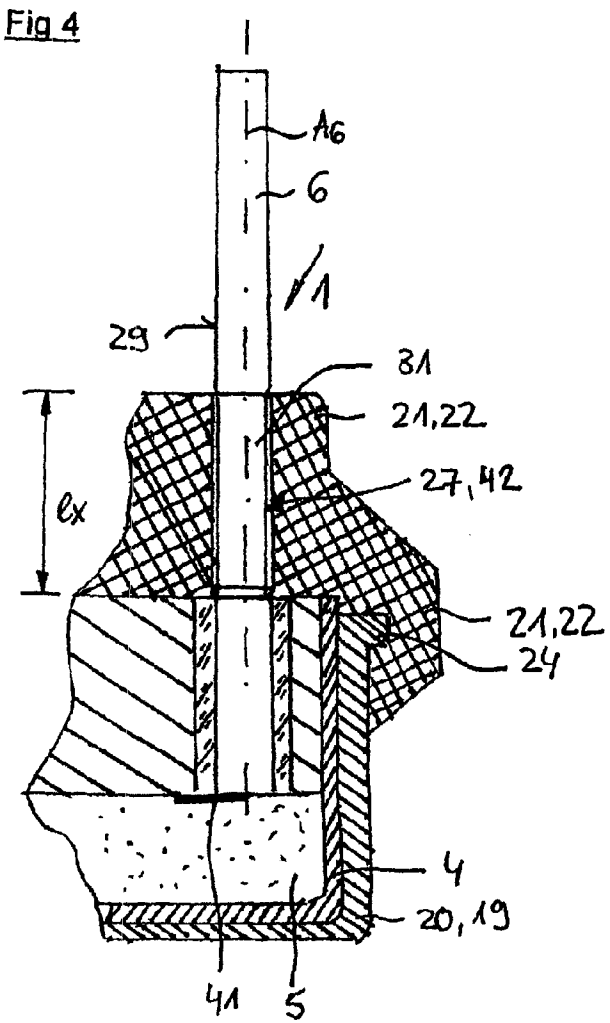
Figure 3:
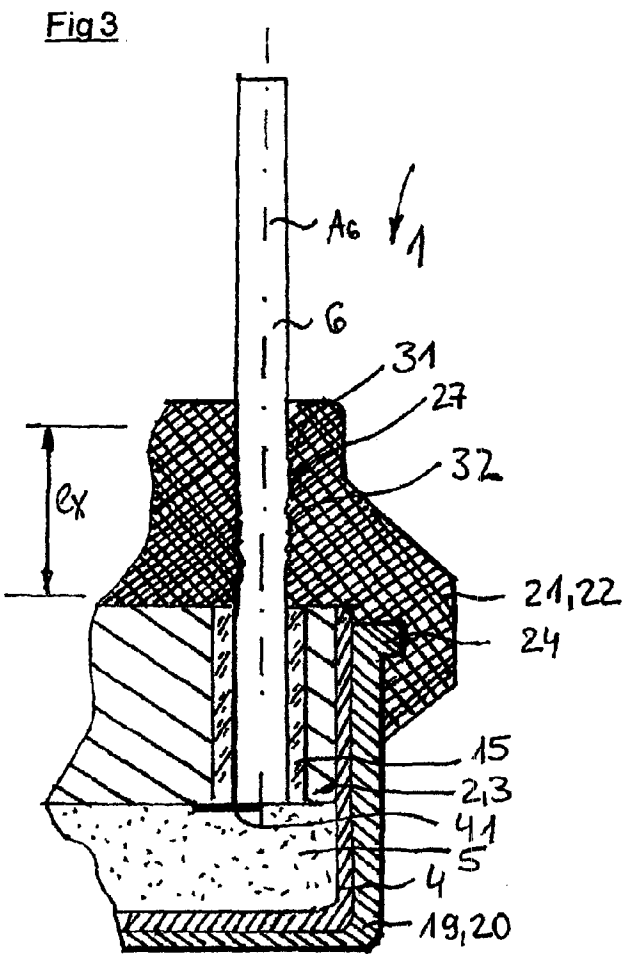
Figure 5A:
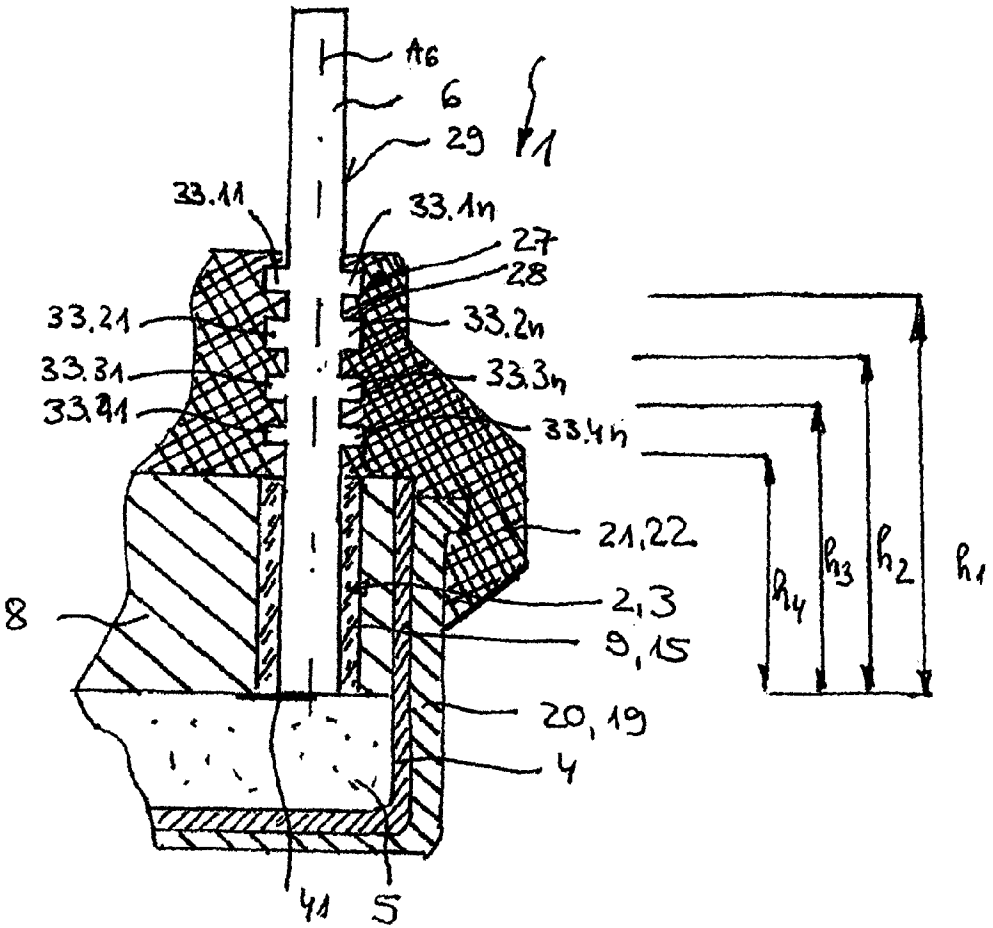
Figure 5B:
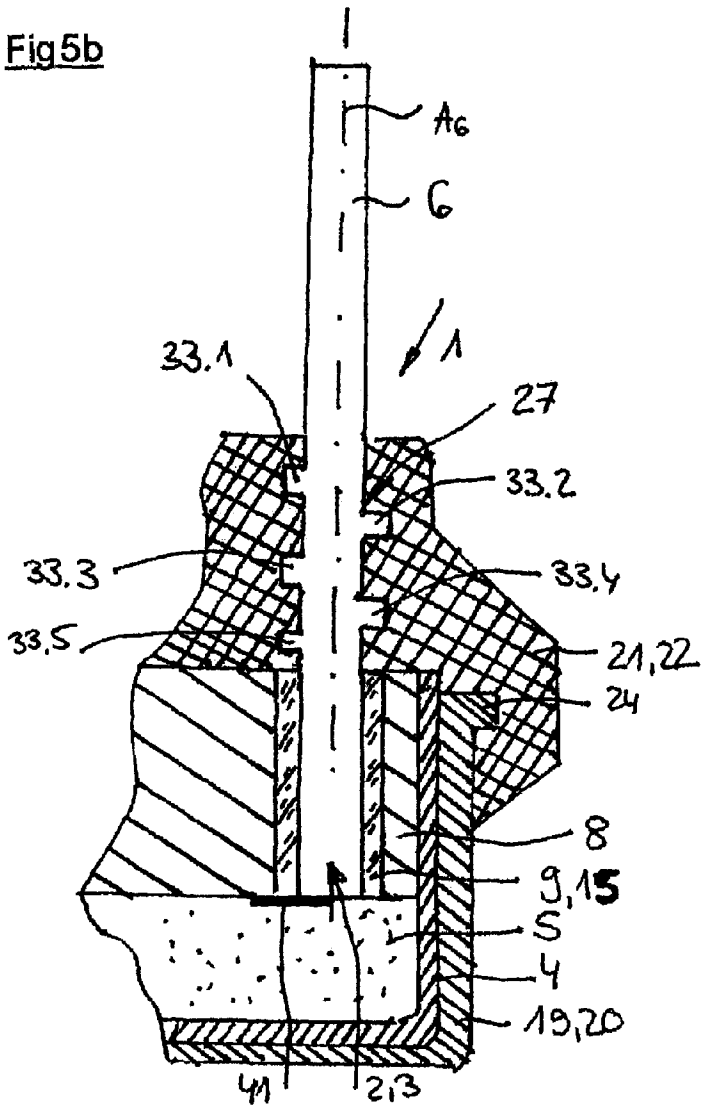
Figure 6:
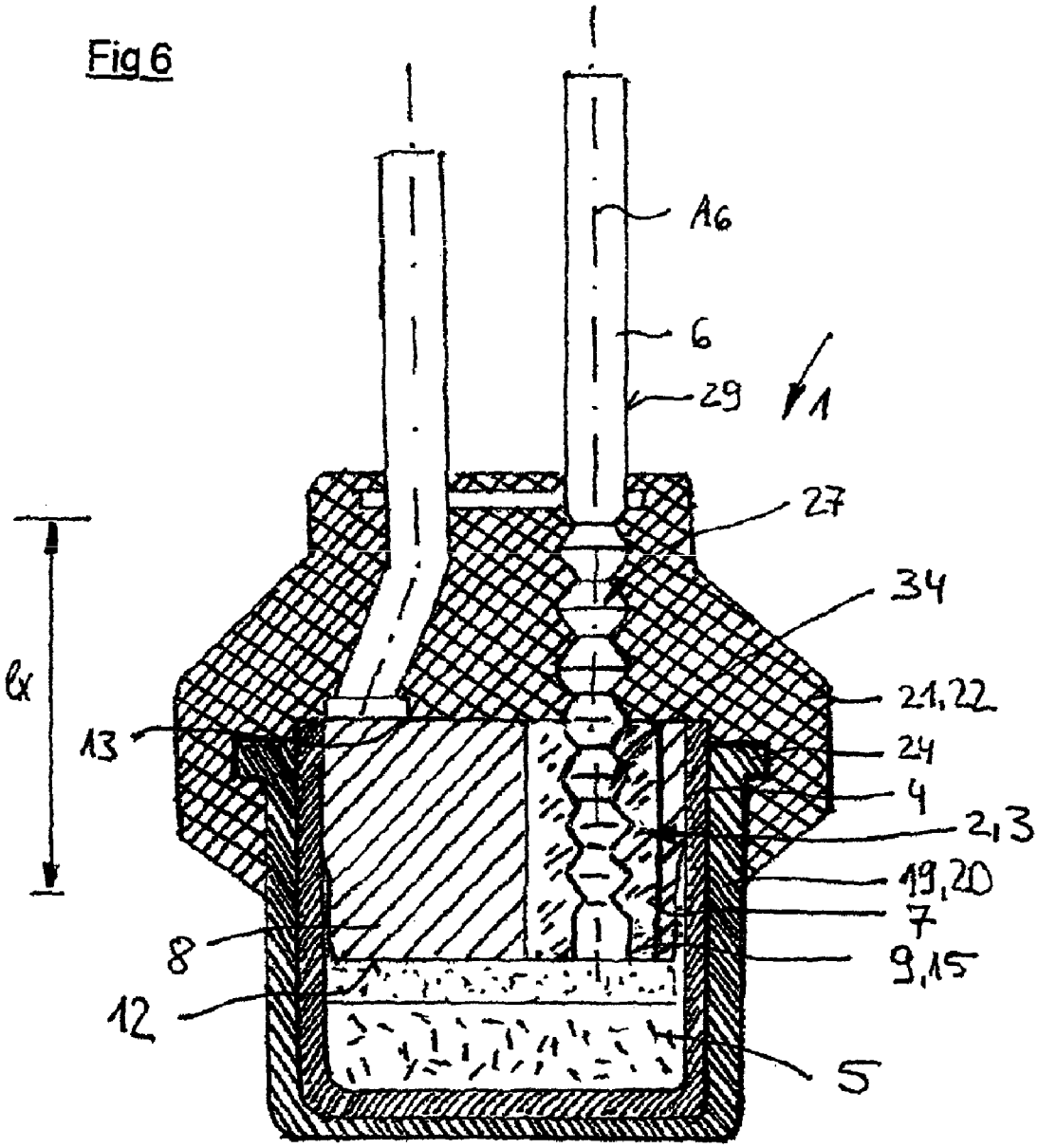

The solution according to the invention is illustrated below based on the figures. They show the following in detail:

FIG. 1*a* clarifies in a simplified illustration an embodiment according to the invention of a firing apparatus in an axial section;

FIGS. 1*b* and 1*c* clarify possibilities for fixing the position of the connecting elements of cap or base in the casing;

FIGS. 2*a* and 2*b* clarify further possibilities of the cross-sectional changes based on a cutout of an axial section according to FIG. 1;

FIG. 3 clarifies an embodiment of the means for preventing the relative movement between the metal pin and the casing having pinching on the outer circumference of the metal pin based on a cutout of an axial section according to FIG. 1;

FIG. 4 clarifies an embodiment of the means for preventing the relative movement between the metal pin and the casing in the form of an outer thread based on a cutout of the axial section according to FIG. 1;

FIGS. 5*a* and 5*b* clarify embodiments of the means for preventing the relative movement between the metal pin and the casing in the form of projections based on a cutout of the axial section according to FIG. 1;

FIG. 6 clarifies a further improvement according to FIG. 1, comprising means for preventing a relative movement between individual elements of the power leadthrough, particularly the metal fixing material leadthrough in the form of ridges on the metal pin;

FIGS. 7*a* to 9 clarify a further improvement of an embodiment according to FIG. 1 comprising means for preventing a relative movement between individual elements of the power leadthrough, particularly the metal fixing material leadthrough in the form of undercuts.

FIG. 1 clarifies an embodiment of the firing apparatus 1 according to the invention for a pyrotechnic protection apparatus, particularly an airbag or belt pretensioner, based on an axial section in a schematically simplified illustration. The same comprises a power leadthrough, particularly a metal fixing material leadthrough 2, particularly in the form of a glass metal leadthrough 3 for an electric ignition and a cap 4 connected to the metal fixing material leadthrough 2, wherein a propellant charge 5 is enclosed between the metal fixing material leadthrough 2 and the cap 4. The metal fixing material leadthrough 2, particularly in the form of a glass metal leadthrough 3, comprises at least one metal pin 6, which is fused in a passage opening 7 into a base body 8 in a fixing material 9. For this purpose the base body 3 preferably has a discoidal base form, and forms a front side 12 and a rear side 13 together with the faces 10 and 11 thereof. The base body preferably has a thickness D of 0.1 mm to 2 mm, particularly in the range of 0.1 mm to 1 mm, preferably between 0.1 mm and 0.80 mm, and is therefore substantially thinner than stamping parts according to prior art. The front side 12 is directed toward the propellant charge 5, the rear side 13 is facing away from the same. In the case illustrated two metal pins are provided, e.g. an additional metal pin 14 adjacent to the metal pin 6. Both metal pins 6 and 14 are arranged parallel to each other. For this purpose one of the same acts as a conductor, while the second of the same is fixed on mass. In the illustrated case the metal pin 6 takes on the function of the conductor, and the metal pin 14 takes on the function of a mass pin. One of the metal pins, particularly the metal pin 6 acting as the conductor, is guided through the base body 8. For this purpose the metal pin 6 is fused in fixing material 9 on a part $l_D$ of the length thereof, particularly in a glass stopper 15 that has been cooled down from a glass melt. The metal pin 6 projects beyond the face 16 of the glass stopper at least on one side, and in the illustrated embodiment ends flush with the second face 17 of the glass stopper after completion of production. The front side 12 of the base body 8 is characterized in that the same is directed toward the propellant charge 5 that is arranged between the cap 4 and the base body 8. The metal pin 6 is arranged in the passage opening 7 such that the same preferably ends flush with the front side 12 of the base body 8. Other variations are also possible, e.g. a projection is also possible. The metal pin 6 extends therefore from the rear side 13 in the direction of the front side 12, thus projecting from the rear side 13. In the illustrated case the metal pin 14 acting as a mass pin is directly attached to the base body 8 on the rear side 13 thereof.

For this purpose the metal pin 6 serves for contacting an electric ignition, such as in the form of a filament as a firing bridge 41, by means of which the propellant charge 5 enclosed in the finished ignition is ignited. For this purpose the fixing material 9, particularly in the form of a glass stopper 15, serves as insulation material between the metal pin 6 and the walls of the passage opening 7 in the base body 8. Such a power leadthrough provides the particular advantage that the same not only electrically insulates very well, but is also hermetically sealed as opposed to atmospheric components, which react with the propellant charge in the course of time or which can mix themselves with the same, and deteriorate the same with regard to the effectiveness thereof. In order to fix the position between the individual elements, particularly the propellant charge 5 and the glass metal leadthrough 3 and both metal pins 6 and 14 the firing apparatus 1 has a housing, which surrounds said elements on the outer circumference. For this purpose the same is embodied in two parts and comprises a first housing part 19, comprising a cover 20 surrounding the cap 4, which is also an integral part of the housing part 19, and a second housing part 21 in the form of a casing 22, which is arranged in the region of the rear side 13 of the base body 8 and surrounds both metal pins 6 and 14 across a partial region of the regions projecting beyond the rear side 13, and which is connected to the first housing part 19, particularly to the cover 20, preferably in a bonded manner, e.g. normally in an non-detachable manner. The housing part 19 accommodates the base body embodied as a stamping part having a low thickness. The casing 22 also adjoins the base body 8 and at least partially surrounds the same. As is obvious to the person skilled in the art the base body is stabilized by means of the casing 22, particularly in case of high pressures. In such a case the casing 22 absorbs part of the pull-out force of the metal pin, or the pressing force thereof.

The positional association between the cap 3, the base body 8, and the propellant charge 5 enclosed thereof is therefore fixed by the casing 22. In the simplest case the fixing is carried out by means of casting. The second housing part 21 is then embodied in the form of a plastic part and surrounds the outer circumferences of the individual metal pins 6 and 14, the base body 4, and at least directly the outer circumference 23 of the cap 4, in this case via the cover 20, in the said partial region. For this purpose the cover 20 has means 47 for preventing a relative movement between the casing 22 and the cap 4, or the housing part 19. In the case illustrated the same are embodied in the form of a collar 24 revolving in circumferential direction and extending in radial direction based on the center axis M. The same acts as an undercut during the casting of the housing part 21. Further, the collar 24 may also be embodied with only one directional component in radial direction, e.g. such as in a schematic view according to FIG. 1*b* as an angular flange. In this case the cap 4 and the cover 20 are embodied, for example, in two parts. However, it is also conceivable to associate the function of the cover 20 and the cape 4 with only one element. The cap 4 is preferably embodied as a metal cap, for example, made of stainless steel, and is hermetically sealed to the base body 8, such as by means of welding. In the embodiment illustrated the cap 4 is equipped with a nylon coating. An embodiment as a metal cap is preferred, because it enables a hermetically sealed connection to the base body in a simple manner, for example, by means of welding. Hermetically sealed as used in the present application means a component having a helium leakage rate of less than $1\cdot10^{-5}$ bars·l/sec, preferably in the range of $1\cdot10^{-10}$ bars·l/sec to $1\cdot10^{-6}$ bars·l/sec. Preferably the helium leakage rate is measured according to DIN EN60068-2-17 or the MIL-STD-883-method 1014.9 condition A4. The measuring devices Model MS 34T by VEECO, or Model UL 400 by LEYBOLD may be utilized as measuring devices for this purpose. Furthermore, a metal cap may also be utilized as ground, if one of the two pins is connected to the metal cap in a conducting manner, such as shown in FIG. 1*a*. The metal cap 4 is also known as a pyrotechnical cap. For this purpose the cap 4 is preferably embodied in a rotation-symmetric embodiment in the shape of a bowl. For this purpose the cap 4 has an open end region 25 which accommodates the base body 8 including the propellant charge 5, which is then arranged between the front side 12 of the metal fixing material leadthrough 2 and a base region 26 of the cap 4, which is arranged opposite of the open region 25 of the cap 4. In the installation situation the cap 4 extends at least beyond a partial region of the thickness d of the base body 8. In other words, the base body 8 plunges merely partially into the cap 4. An embodiment having a complete accommodation of the base body 8, or a flush finish with the cap 4, is also conceivable. The collar 24 of the cover 20 surrounding the cap 4 extends in a rotation-symmetric embodiment based on a theoretic center axis M of the cap 4 in radial direction toward the outside, e.g. away from the outer circumference 38 of the cover 20. The collar 24 extends at an angle, preferably perpendicular to the center axis M. In this manner an undercut is quasi formed for the second housing part 21 in the form of the casing 22, which enables a catching between the cap 4 or the cover 20 surrounding the same, and the casing 22, and simultaneously takes on a sealing function in that the casing 22 closely abuts at the outer circumference 38 of the cover 20 and of the front side, particularly the rear side 13 of the base body and a partial region of the outer circumference 23 of the cap 4 in a sealing manner, e.g. free of any hollow spaces.

Substantial parameters of such a firing apparatus 1 are the pressing force and the pull-out force. The pressing force is the force that must be exerted in order to press the fixing material 9 that has been inserted in the passage opening 7 of the metal fixing material leadthrough 2, out from the leadthrough. The amount of said pressing force may be determined either hydrostatically or mechanically. The pull-out force is the force required in order to pull out the metal pin, particularly the metal pin 6, from the metal fixing material leadthrough 2 out from the fixing material 9. Different possibilities are known according to prior art in order to increase the pull-out force, wherein the same may be limited, however, with regard to the design and layout of the metal fixing material leadthrough 2, thereof, particularly the size or thickness d of the base body 8. In order to generally increase the pull-out force regardless of the design and layout of the metal fixing material leadthrough 2, particularly of the base body 8, means 27 for preventing a relative movement between each individual metal pin, particularly metal pin 6 and the housing part 21 surrounding the metal fixing material leadthrough 2 are provided in the form of the casing 22 made of plastic. Said mains 27 may be embodied in a plurality of forms.

FIG. 1, particularly FIG. 1*a*, illustrate a particularly advantageous embodiment that is particularly effective with regard to the effectiveness thereof, and which is characterized by a low production-technical expense. For this purpose the means 27 comprise at least one, preferably a plurality of surface regions 28.11 to 28.*n*2 embodied on the outer circumference 29 of the metal pin 6 guided at least through the leadthrough, which based on the longitudinal axis $A_6$ of the metal pin, in this case the metal pin 6, are aligned at an angle to the same, preferably extending perpendicularly. The metal pin 6, or in case of an embodiment having two metal pins 6 and 14 the same are embodied in a bent manner in the region arranged in the second housing part 21 in the conventional embodiment thereof, e.g. the single metal pin is characterized by a plurality of longitudinal axis regions, wherein two are aligned parallel to each other, and the third extends between the two parallel aligned longitudinal axis regions at an angle to the same. In this manner such an embodiment of the metal pin 6 can be omitted by means of the measure according to the invention, e.g. the same may be embodied as a straight metal pin that is characterized by a single longitudinal axis $A_6$. In this case the single metal pin 6 characterized by a longitudinal axis $A_6$ is free of directional changes of said longitudinal axis $A_6$. In the simplest case the surface regions 28.11 to 28.*n*2 are realized by means of ridges 30 or grooves 40 incorporated into the metal pin 6 on the outer circumference 29. The ridges 30 create cross-sectional changes 39, particularly local cross-sectional reductions or projections in the circumferential direction of the single metal pin 6 across the extension thereof when viewed parallel to the center axis of the metal pin 6. The same are arranged in a locally limited manner. For this purpose such cross-sectional reductions are arranged at least in a partial region 31 of the metal pin 6 extending from the rear side 13, particularly in the region of the metal pin 6 surrounding the casing 22, which is characterized by a length $l_x$. The ridges 30 are preferably incorporated perpendicular to the center axis corresponding to the longitudinal axis $A_6$ of the metal pin 6, thus enabling a gearing with the casing 22, e.g. a positive fit with the same. The material of the casing 22 entering into the ridges 30 during the casting process of the casing 22 quasi forms a type of barb for the movement of the metal pin 6 along the longitudinal axis $A_6$ thereof. In the illustrated case different surfaces may be realized depending on the embodiment of the ridges 30 or grooves, particularly of the ridge cross section. However, they all have in common the barb effect during the interaction with the material of the casing 22. For example, the embodiment of the surface regions 28 formed by means of the ridges 30 occurs in a perpendicular manner, e.g. at an angle of 90 degrees to the longitudinal axis $A_6$ of the metal pin 6 in this region. Preferably, however, the surface regions extend in an angular region of between 10 and 170 degrees, particularly preferred of 30 to 150 degrees, especially preferred of 45 to 135 degrees. The cross-sectional geometry of the ridges 30 may be embodied in a manifold manner. In the simplest case the same is realized in an idealized triangular manner.

FIG. 1*c* shows only schematically simplified an embodiment according to the invention of the metal pin 6 according to FIG. 1*a* or 1*b* having a fixation of the base body 8 in the casing 22. For this purpose respective means 48 are provided, which in the simplest case are formed as projections extending away on the base body 8 in radial direction on the outer circumference thereof, preferably as a circumferential flange 49. The embodiments illustrated in FIGS. 1*b* and 1*c* may be used as an alternative, or in combination.

FIGS. 2*a* and 2*b* illustrate in a schematically simplified illustration further possible cross-sectional geometries of the local cross-sectional changes, particularly the cross-sectional reductions, based on a cutout from an axial section across a firing apparatus 1 according to FIG. 1*a*. Any geometry resulting to a local cross-sectional change, particularly an expansion or reduction, is conceivable. In the embodiment according to FIG. 2*a* the local cross-sectional changes 39 are embodied on the outer circumference 29 of the metal pin 6 in the form of grooves 40 having a segment circular cross-section, while the geometry of the grooves 40 according to FIG. 2*b* is embodied, for example, in a trapezoid manner. For this purpose the individual grooves 40 preferably extend completely about the outer circumference 29 of the metal pin 6 in the circumferential direction, e.g. are embodied in a continuous manner. The possibility of an extension (not illustrated) across only a partial region of the outer circumference 29 in the circumferential direction, e.g. in the form of groove segments, is also conceivable.

On the other hand FIG. 3 illustrates a further embodiment according to FIG. 1*a*, wherein the means 27 comprise local pinching, herein denoted with 32, and which lead to a cross-sectional reduction of the metal pin 6 in this region, and which form a type of barb by means of the surface regions 28 obtained by means of the cross sectional reduction in interaction with the casing 22. The local pinching may be created in different manners, preferably by means of a special surface treatment and/or processing in the said partial region 31.

As explained above, FIG. 1*a* illustrates a particularly advantageous and easy to realize embodiment of the means 27 for preventing the relative movement of the metal pin 6 in the casing 22, thus increasing the pull-out force of the metal pin 6 from the metal fixing material leadthrough 2, particularly in base bodies having a very low thickness D. FIG. 4 illustrates an alternative embodiment to producing multiple such surface regions being aligned at an angle to the longitudinal axis of the metal pin. In the case illustrated the same are formed by a thread 42 that is preferably characterized by an increase in the region of 0.15 to 0.45. The advantage of threads is that the same can be incorporated relatively easily into components being embodied in a rotation symmetric manner. The flange lines in the same are aligned at an angle to the longitudinal axis.

On the other hand FIGS. 5*a* and 5*b* illustrate embodiments having projections 33 at the outer circumference 29 of the metal pin 6. For this purpose the same may be a single projection 53 completely extending in circumferential direction, or a plurality of individual projections 33.1 to 33.*n*, which are arranged on the outer circumference in any desired manner, but which extend away from the outer circumference 29 in radial direction based on the longitudinal axis $A_6$ of the same, thus causing a cross-sectional change in the sense of an expansion in said region. For this purpose the individual projections 33.1 and 33.*n* may be arranged at the same height or at different heights $h_1$ to $h_n$ based on the longitudinal axis $A_6$ in the direction of the same, wherein the arrangement in circumferential direction in turn may be carried out at an offset to each other, or at a uniform distance from each other in circumferential direction about the outer circumference of the metal pin 6. FIG. 5*a* illustrates an embodiment having multiple individual projections 33.11 to 33.1*n* and 33.*n*1 to 3*nn*, wherein the projections 33.11 to 33.1*n* are arranged at a uniform height $h_1$ to $h_4$ when viewed in longitudinal direction of the longitudinal axis $A_6$ of the metal pin 6, and the arrangement of the individual projections 33.11 to 33.1*n*, 33.21 to 33.2*n*, 33.31 to 33.3*n*, and 33.41 to 33.4*n* preferably are each carried out at uniform distances in circumferential direction to each other.

On the other hand, FIG. 5*b* illustrates an embodiment having any desired number of projections arranged on the metal pin 6. The positions of the individual projections 33.1 to 33.*n* are selected in any desired manner along the longitudinal axis $A_6$ and are arranged on the circumference 29 of the metal pin 6.

The embodiments according to FIGS. 5*a* and 5*b* are characterized by cross-sectional enlargements of the metal pin 6.

FIG. 6 illustrates a particularly advantageous further improvement according to FIG. 1*a*, where the ridges 30 are not only located outside of the region on the metal pin 6, which projects beyond the rear side 13 from the metal fixing material leadthrough 2, but preferably extend at least partially into the metal fixing material leadthrough 2. In this case both means 27 for preventing the relative movement between the metal pin 6 and the casing 22 and additional means 34 enabling the prevention of a relative movement between the metal pin 6 and the fixing material 9, particularly a glass stopper 15, may be provided in a single operation. The stability of the metal pin 6 in the glass stopper 15, and thus the pull-out force may be further increased via said means 34. Preferably the incorporation is carried out in one operation. For this purpose it is not important how the metal fixing material leadthrough 2 itself is embodied.

The embodiments illustrated in FIGS. 1 to 6 enable a particularly material saving thin embodiment of the base body 8. The base body is preferably a discoidal element that is preferably embodied as a stamping part. In the base body 8 at least the passage opening thereof is produced by means of stamping. In a further improved embodiment the entire base body, e.g. the outer circumference of the base body and the passage opening are produced by means of stamping. In this case the base body 8 would be embodied as a stamping part in its entirety. The same may be characterized by low thickness ratios, and therefore short lengths for the passage opening. High stability of the entire system can be realized in a simple manner regardless of the dimensioning by means of the metal fixing material leadthrough 2 by means of the measure according to the invention, particularly by means of providing the means 27 on the single metal pin 6 in the region of the casing 22, wherein metal fixing material leadthroughs 2 having a small thickness may also be used. In particular, the invention also enables embodiments having a particularly small thickness D of the metal fixing material leadthrough 2. The thickness D means the extension or dimension in the height direction or in the direction of the extension of the passage opening 7. The geometric axis of the passage opening is determined by the embodiment of the same. In a symmetric embodiment the same corresponds to the symmetric axis, otherwise the same corresponds, for example, to the theoretic center axis.

Base bodies according to the invention having thicknesses of between 0.1 mm and 2 mm, preferably 0.1 mm and 1 mm, particularly 0.1 mm and 0.8 mm are utilized for use in firing apparatuses 1 for airbags. This means that even with continuously large metal pins 6, 14 a substantial savings of material is characterized due to the small dimensions as opposed to an embodiment of the base body 8 as a pivoting part having thicknesses of, for example, 3.2 to 5 mm, and further due to a simple and energy-saving production. Up to 50% of the material costs and particularly of the costs for waste material of the stamped parts may be avoided by means of using the thinner material.

As described above, the means 27 for preventing the relative movement between the metal pin 6 and the casing 22 may additionally be combined with means 34 for preventing a relative movement between the individual elements of the metal fixing material leadthrough 2. The selection of possibilities depends on the design and layout of the individual elements of the metal fixing material leadthrough 2. As described above, for this purpose the means may be provided on the outer circumference of the metal pin 6 according to FIG. 6, or between the fixing material 9 and the passage opening 7. For this purpose the means 34 are embodied as means for preventing a relative movement between the fixing material 9 and the inner circumference 35 of the passage opening 7 in the direction of the rear side 13. The same quasi act as barbs and bring about a form fit between the base body 8 and the fixing material 9 under the effect of a tractive force and/or pressure on the fixing material 9 and/or on the metal pin 6 and therefore prevent the gliding out on the rear side 13.

Figure 7A:
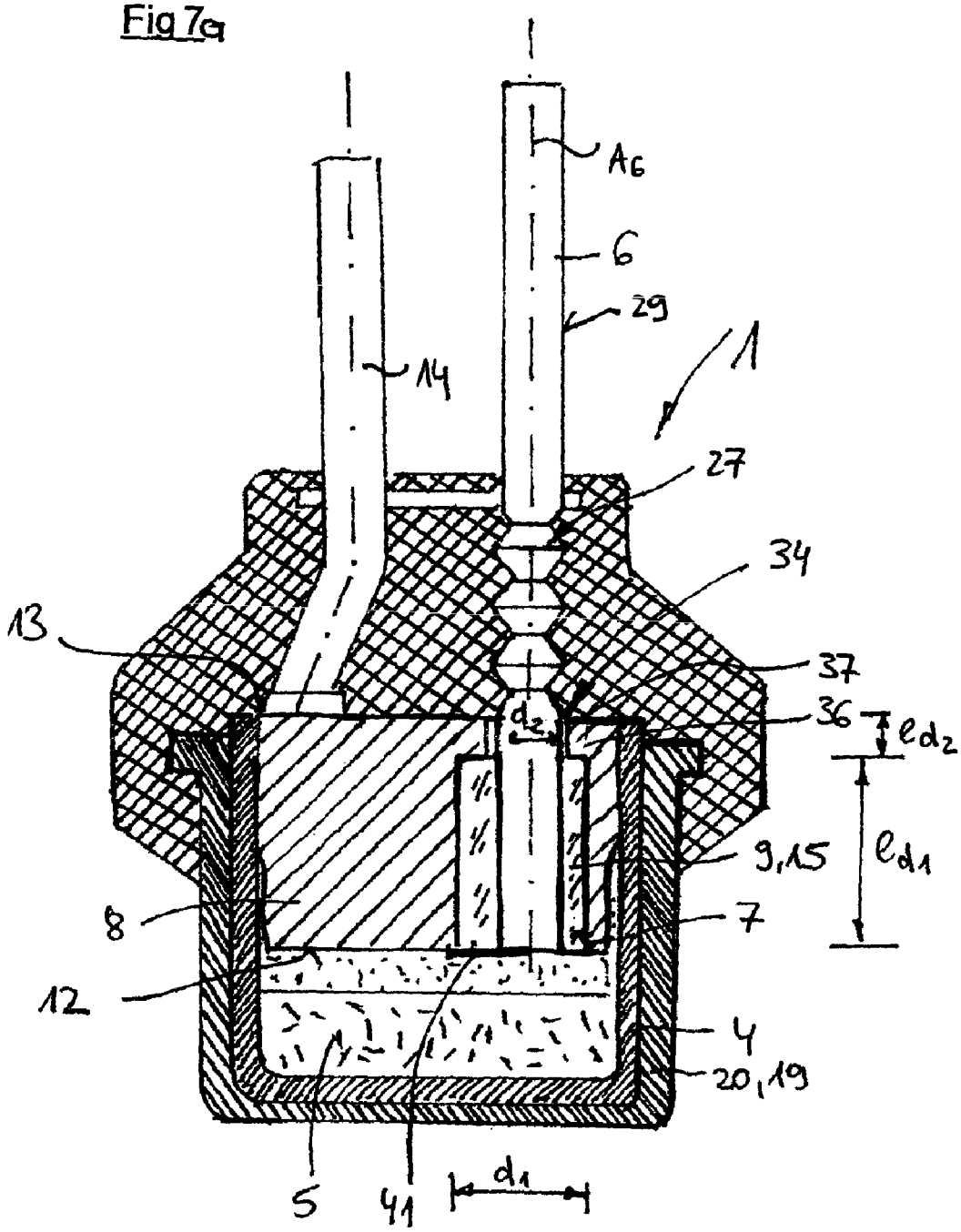

FIG. 7*a* illustrates, for example, a possible first embodiment according to a further improvement of FIG. 1*a*. For this purpose the passage opening 7 is embodied such that the same has an undercut 36 that is formed by a projection 37. The same is arranged in the region of the rear side 13 and ends flush with the same in the case illustrated. The passage opening 7, which has a circular cross-section in the illustrated case, is characterized by two different diameters $d_1$ and $d_2$ by means of said projection 37. For this purpose the diameter $d_1$ is greater than the diameter $d_2$. The diameter $d_2$ is the diameter of the passage opening 7 on the rear side 13. The diameter $d_1$ is formed by the diameter of the passage opening 7 on the front side 12. For this purpose the passage opening 7 is embodied across a substantial part of the extension $l_{d1}$ thereof at the same diameter $d_1$. $l_{d2}$ stands for the embodiment of the passage opening 7 at the diameter $d_2$. This means that the passage opening 7 has two partial regions; a first partial region and a second partial region, wherein the first partial region is characterized by the diameter $d_1$ and the second partial region by the diameter $d_2$. For this purpose said diameters may be created preferably as a stamping part depending on the embodiment of the base body 8 by means of a one-sided stamping operation in the form of hole-punching on the front side 12 or rear side 13 with subsequent deforming operation under pressure, particularly by means of embossing. The starting force can be doubled in embodiments having an equally designed base body alone by providing said undercut 36.

The passage opening 7 may have a circular cross-section. However, other forms, such as an elliptical form, are also conceivable, wherein the undercut 36 is formed by changing the interior dimensions of the opening in this case. Furthermore, the geometries illustrated in the Figures are rendered in an idealized manner. For example, in practice surface regions being completely at a right angle to each other will usually not be created. Of key importance is that a base contour of the passage opening is created, which fulfills both the accommodation of the metal pin 6 and the preventing of a moving out of the entity from the metal pin 6 and the fixing material 9, particularly the glass stopper 15. This means that both the surface regions forming the undercut 36 and the adjoining surface regions can be arranged at an angle to each other.

Figure 7B:
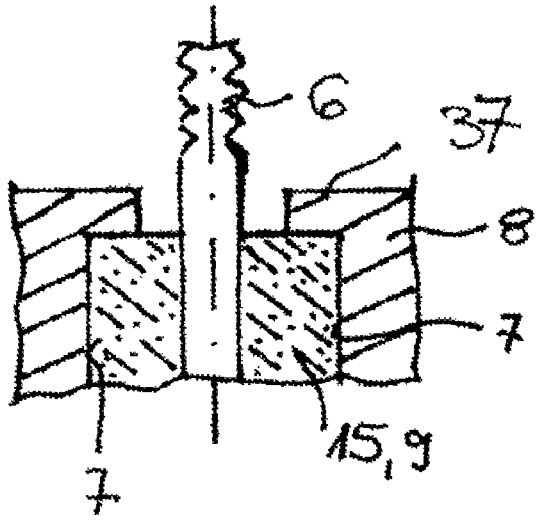
Figure 8B:
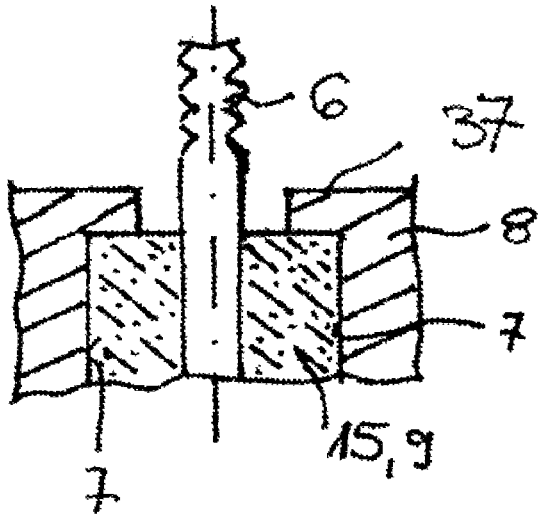
Figure 8A:
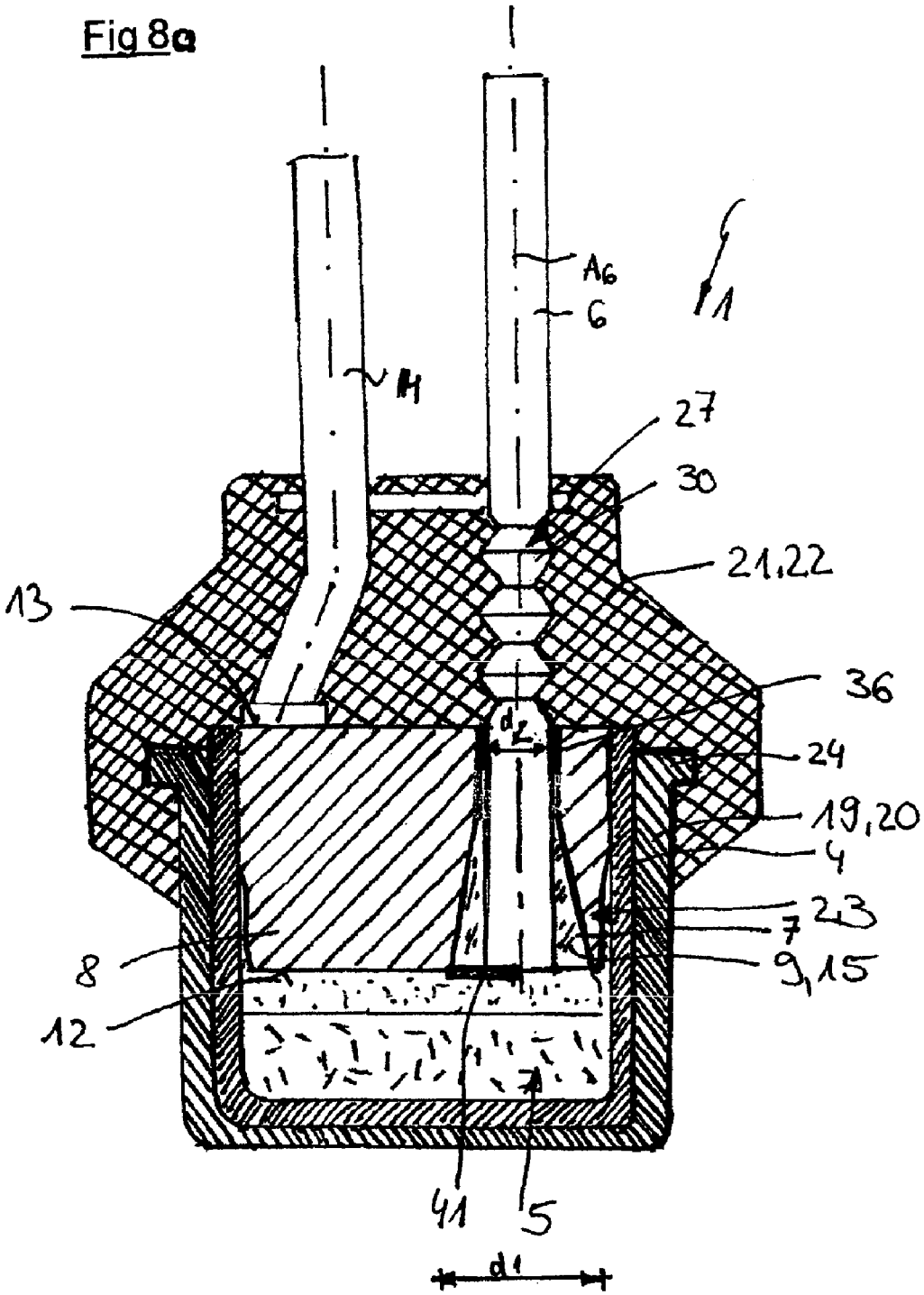

According to a further improvement according to FIG. 1*a*, FIG. 8*a* illustrates a further embodiment of the means 34, wherein only part of the passage opening 7 is embodied in a conical manner. In this embodiment the passage opening is also divided into two partial sections; a first partial region and a second partial region. The second partial region is characterized by a constant diameter $d_2$ across the length $l_{d2}$ thereof. The second partial region extends from the rear side 13 in the direction of the front side 12. The first partial region is characterized by a continuous cross-sectional reduction of the passage opening 7. The reduction is carried out from a diameter $d_1$ to a diameter $d_2$. The smaller diameter on the rear sides 13 according to the embodiments in FIGS. 7 and 7 provide the advantage of a larger connecting surface for the second metal pin 14, particularly the mass pin. The undercut 36 results due to the diameter change when viewed from the second to the first partial region.

In the embodiments illustrated in FIGS. 7*a* and 8*a* the asymmetrical geometry of the passage opening 7 when viewed from the front side 12 toward the rear side 13 provides the advantage of preventing a gliding out or pulling out of the glass stopper 15 on the rear side 13, or in the direction of the same. Furthermore, a better orientation for the installation situation of the individual elements, particularly of the metal pins 6 and 14, can be provided during installation by means of the asymmetrical geometry. Due to the undercut 36 a sliding out of the assembly made up of the metal pin 6 and the glass stopper 15 from the base body 8 is prevented during firing.

FIG. 7*b* illustrates in a schematically simplified manner the embedding of the metal pin 6 in the glass stopper 15 that is free of any direct contact to the base body 8 in detail, based on a cutout according to FIG. 7*a*. In order not to cause a short circuit in the region of the base body 8 in case of a non-complete embedding in the fixing material 9 the passage opening is characterized by a greater diameter than the outer diameter of the metal pin 6 in the base body 8 in the region free of fixing material 9. In this case the fixing material 9, particularly the glass stopper 15, is fixed on a projection 37 on the base body 8 in the passage opening 7 in the pushing out direction. However, the same is positioned at a distance to the outer circumference of the metal pin 6 in radial direction based on the center axis of the passage opening. In this manner the metal pin is indirectly fixed in the passage opening via the glass stopper 15. By analogy the same is true for the embodiment according to FIG. 8*b* as a detail based on a cutout of an embodiment according to FIG. 8*a*.

Figure 9:
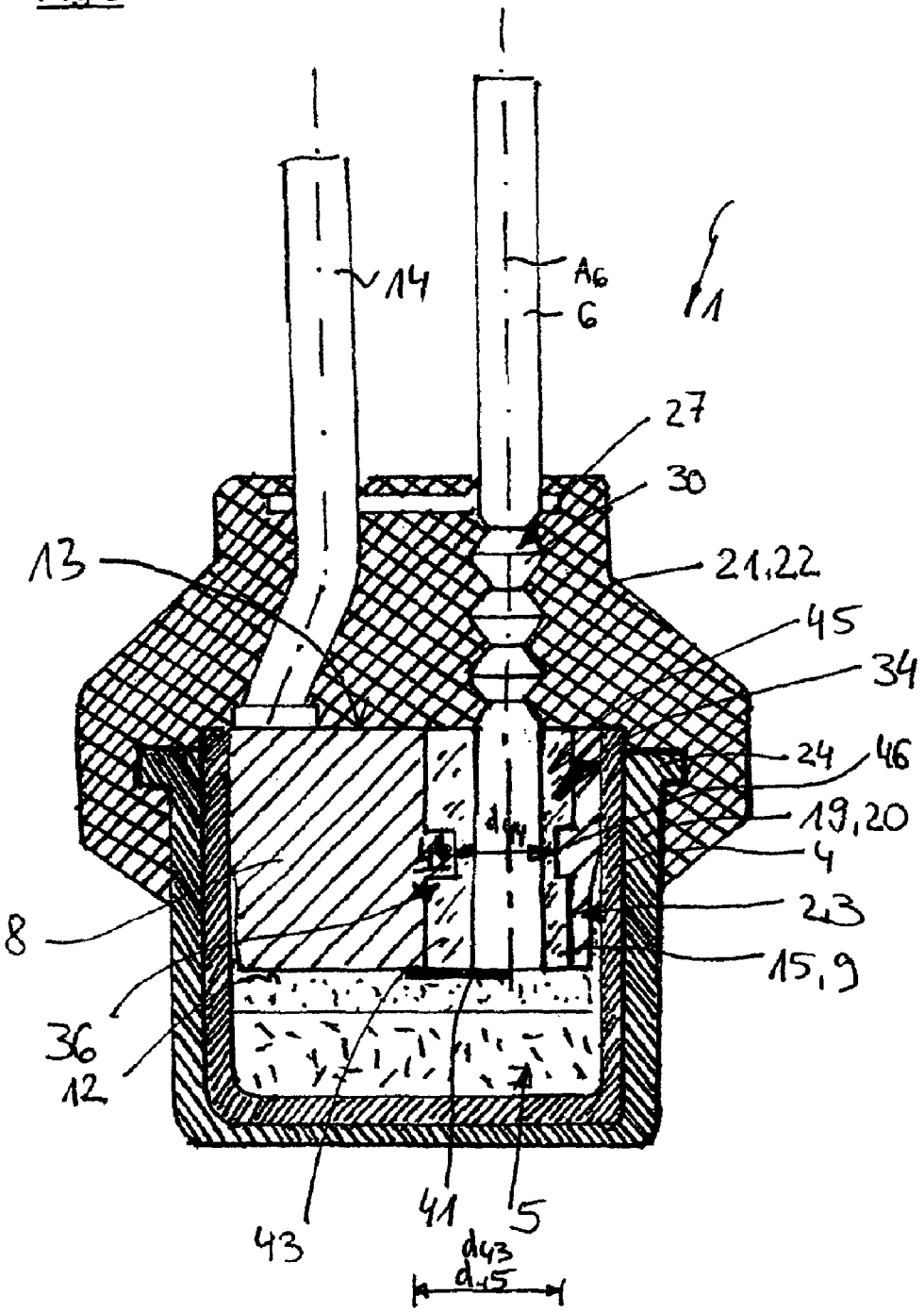

FIG. 9 illustrates a further embodiment of a further improvement according to FIG. 1. In said embodiment the passage opening 7 can be divided into three partial regions 43, 44, and 45, wherein the first and the third partial regions 43, 45 are preferably characterized by equal diameters $d_{43}$ and $d_{45}$. The second partial region is characterized by a smaller diameter $d_{44}$ than the diameters $d_{43}$ and $d_{45}$, thus forming a projection 46. The same forms the undercut 36 arranged between the front and rear sides 12, 13 for preventing the relative movement of the glass stopper 15 in the direction of the rear side 13 as opposed to the interior circumference of the passage opening 7. Particularly the surfaces directed toward the front side 12 and the rear side 13 form the contact surfaces for the glass stopper 15 in axial direction. Said embodiment is characterized quasi in both directions by means of fixing the glass stopper 15 such that said embodiment of the base body is suited in a particularly advantageous manner for any desired installation and positioning, particularly with regard to the contacting of the metal pins 6 and 14. For this purpose the embodiments requires an increase of the pressing force in order to cause the movement of the glass stopper 15 under pressure while shearing parts of the same.

The possibilities illustrated in FIGS. 7 to 9 are by way of example. In addition to a combination using the embodiment according to FIG. 1 the same can also be combined with the embodiments according to FIGS. 2 to 5.

While the exemplary embodiments described refer entirely to metal fixing material leadthroughs 2, or glass metal leadthroughs 3 comprising two metal pins 6 and 14 which are preferably arranged in a parallel manner, wherein one of the two metal pins 6 or 14 are positioned on mass on the rear side 13 of the base body 8, the invention can principally also be utilized with more than two metal pins and with so-called mono-pins. The latter are firing units having only a single metal pin being supported by a pin carrier. The pin carrier itself comprises, for example, a metal ring which embodies the mass connection.

List Of Reference Symbols

1 firing apparatus
2 metal fixing material leadthrough
3 glass metal leadthrough
4 cap
5 propellant charge
6 metal pin
7 passage opening
8 base body
9 fixing material
10 face
11 face
12 front side
13 rear side
14 metal pin
15 glass stopper
16 face of the glass stopper
17 second face of the glass stopper
18 housing
19 first housing part
20 cover
21 second housing part
22 casing
23 outer circumference
24 collar
25 open end region

26 base region
27 means for preventing a relative movement between the metal pin and the casing
28 surface region
29 outer circumference
30 ridges
31 partial region
32 local pinching
33 projection
**33.1-33.*n*** projections
34 means for preventing a relative movement between the individual elements of the metal fixing material leadthrough
36 undercut
37 projection
38 outer circumference of the cover
39 cross-sectional change
40 groove
41 firing bridge
42 thread
43 first partial region
44 second partial region
45 third partial region
46 projection
47 means
48 means
49 projection
$A_6$ longitudinal axis
D thickness
$d_1$ diameter
$d_2$ diameter
$l_x$ length of the arrangement of the means 27

The invention claimed is:

1. A firing apparatus for a pyrotechnic protection apparatus, particularly an airbag or belt pretensioner, comprising:

a power leadthrough, particularly a metal fixing material leadthrough comprising a base body equipped with a passage opening, and at least one metal pin being arranged in the passage opening in the base body in a fixing material;

a housing part, including a cap, at least partially accommodating the power leadthrough while forming an intermediate space for accommodating a propellant charge;

a casing which at least partially surrounds the power leadthrough, the metal pin, and the housing part; wherein the base body has a thickness in the range of 1.0 mm to 0.1 mm, and provides a hermetic seal with the housing part which accommodates the propellant charge, and means are provided on the metal pin such that the casing is engaged with the metal pin, wherein the casing and the base body together absorb a pull-out force of the metal pin which is greater than 150 N, and the casing protects the base body against bending during firing.

2. The firing apparatus according to claim 1, characterized in that the means are provided at least in a partial region of the extension of the metal pin in the casing.

3. The firing apparatus according to claim 1, characterized in that the means are formed by ridges or grooves extending about the outer circumference of the metal pin, wherein the ridges or grooves extend at an angle to the longitudinal axis of the metal pin.

4. The firing apparatus according to claim 1, characterized in that the means comprise an outer thread being arranged on the outer circumference of the metal pin.

5. The firing apparatus according to claim 1, characterized in that the means comprise material constrictions and pinching provided on the outer circumference of the metal pin.

6. The firing apparatus according to claim 1, characterized in that the means comprise at least one projection being arranged on the outer circumference of the metal pin and being aligned in radial direction.

7. The firing apparatus according to claim 1, characterized in that at least two metal pins are provided.

8. The firing apparatus according to claim 7, characterized in that the second metal pin is placed on mass as the mass pin on the rear side of the base body.

9. The firing apparatus according to claim 1, characterized in that a metal pin is provided which is arranged in a passage opening in the base body in a fixing material, and a bushing of the base body being placed on mass.

10. The firing apparatus according to claim 1, characterized in that the casing is made of a plastic, a fiberglass reinforced plastic, a glass powder in a polymer matrix, particularly a polyamide, particularly nylon.

11. The firing apparatus according to claim 1, characterized in that the base body has a front side and a rear side directed toward the propellant charge, and means for preventing a relative movement between the individual elements of the power leadthrough.

12. The firing apparatus according to claim 1, characterized in that the base body is a metal part, wherein the outer contour of the metal part and/or of the passage opening of the base body is obtained by means of a stamping process.

13. The firing apparatus according to claim 12, characterized by the following features:

the passage opening is characterized by two partial regions - one partial region extending from the rear side in the direction of the front side, and a further partial region extending from the front side in the direction of the rear side;

the projection is formed by the first partial region extending from the rear side in the direction of the front side, and which is characterized by smaller interior dimensions than the further partial region;

both partial regions have a continuous geometry across the length thereof, having constant interior dimensions in the partial regions.

14. The firing apparatus according to claim 12, characterized by the following features:

the passage opening is characterized by two partial regions - one partial region extending from the rear side in the direction of the front side, and a further partial region extending from the front side in the direction of the rear side;

the projection is formed by the first partial region extending from the rear side in the direction of the front side, and which is characterized by smaller interior dimensions than the further partial region;

both partial regions have a continuous geometry across the length thereof, and/or having constant interior dimensions in the partial regions.

15. The firing apparatus according to claim 1, characterized in that the housing part, particularly the cap, is hermetically sealed to the power leadthrough.

16. The firing apparatus according to claim 15, characterized in that the housing part, particularly the cap is hermetically sealed to the base body of the power leadthrough by means of welding.

17. A method for the production of a metal fixing material leadthrough for a pyrotechnic protection apparatus, particularly an airbag or a belt pretensioner, comprising the following steps:

producing a base body having a thickness in the range of 1.0 mm to 0.1 mm, the base body defining a passage opening;

fixing a metal pin in the passage opening in a fixing material resulting in a power leadthrough;

inserting a bridge wire;

hermetically sealing a housing part accommodating pyrotechnic material to the base body; and at least partially surrounding the housing part, the power leadthrough, and the metal pin with a casing to produce a metal fixing material leadthrough for a pyrotechnic protection apparatus wherein the casing and the base body absorb a pull-out force of the metal pin greater than 150 N, and the casing protects the base body against bending during firing.

18. The method according to claim 17, characterized by forming the passage opening is produced in the base body by means of a stamping operation.

19. The method according to claim 17, characterized by securing the metal pin to the fixing material and to the base body by means of heating.

20. The method according to claim 17, characterized by securing the casing to the housing part, the power leadthrough, and the metal pin by means of heating.

* * * * *